US006045421A

United States Patent [19]

Hiraoka et al.

[11] Patent Number: 6,045,421

[45] Date of Patent: Apr. 4, 2000

[54] COMPONENT COOLING FOR OUTBOARD MOTOR

[75] Inventors: Noriyoshi Hiraoka; Hitoshi Watanabe; Kazuhiro Nakamura; Masanori Takahashi, all of Hamamatsu, Japan

[73] Assignee: Sanshin Kogyo Kabushiki Kaisha, Japan

[21] Appl. No.: 09/103,413

[22] Filed: Jun. 24, 1998

[30] Foreign Application Priority Data

Jun. 24, 1997 [JP] Japan ..... 9-181877

[51] Int. Cl.[7] ..... B63H 20/32

[52] U.S. Cl. ..... 440/77

[58] Field of Search ..... 440/88, 89, 77; 123/195 P

[56] References Cited

U.S. PATENT DOCUMENTS

| | | | |
|---|---|---|---|
| 4,632,662 | 12/1986 | Handa | 440/52 |
| 5,207,186 | 5/1993 | Okita | 123/41.31 |
| 5,899,778 | 5/1999 | Hiraoka et al. | 440/88 |

*Primary Examiner*—Jesus D. Sotelo

*Attorney, Agent, or Firm*—Knobbe, Martens, Olson & Bear, LLP

[57] ABSTRACT

Two embodiments of outboard motor constructions that employ an improved mounting arrangement for certain electrical components such as ECUs and rectifier regulator units. The mounting arrangement places these components in proximity to the intake system for the engine so that the flow of intake air to the engine will assist in cooling the electrical components. A shrouding arrangement is also provided so as to protect the components from water vapor while not inhibiting the cooling air flow.

15 Claims, 8 Drawing Sheets

COMPONENT COOLING FOR OUTBOARD MOTOR

BACKGROUND OF THE INVENTION

This invention relates to an outboard motor and more particularly to an improvement for cooling the components and particularly the electrical components associated with the engine of an outboard motor.

It is well known that there are a number of substantial design challenges for engineers in connection with outboard motors. Because of the extreme compact nature of an outboard motor, some design problems are presented that are not common in other applications of power plants.

One of the areas where the challenge is the greatest is in the design of the engine and the powerhead. Generally, an outboard motor is comprised of a powerhead and a drive shaft housing lower unit that depends from the powerhead. The powerhead includes a powering internal combustion engine and a surrounding protective cowling. The engine drives a drive shaft which depends into the drive shaft housing and which drives a propulsion device through a transmission in the lower unit for propelling the associated watercraft.

With the tendency to improve performance and reduce weight, the space available for the necessary engine size continues to diminish. This problem is compounded by the fact that an electronic control system is preferably used for controlling portions of the engine operation to improve its efficiency and performance. Many of the components associated with the electrical control system must be cooled in order to operate at their maximum efficiency and to avoid damage.

It has been proposed in connection with outboard motors to mount the electrical components or some of them mounted in proximity to the inlet opening of the protective cowling. Alternatively the components may be mounted on the air silencer or intake device associated with the engine. Examples of these construction can be seen in U.S. Pat. No. 4,632,662 issued Dec. 30, 1986 and entitled "Mounting Structure for an Electronic Parts Unit of an Outboard Engine" and U.S. Pat. No. 5,207,186 issued May 4, 1993 and entitled "Arrangement for Mounting an Electronic Control Unit on an Engine." These devices are effective in ensuring that the electrical components will be well cooled. There are, however, some disadvantages with the structures.

For example, the structure shown in U.S. Pat. No. 4,632,662 mounts the component in proximity to the air inlet of the protective cowling so that the inlet air will flow over the electrical unit for its cooling. However, it is well known that the air that is drawn into the protective cowling through its inlet opening may contain large amounts of water either in vapor or liquid form. Thus, corrosion, shorting, and other problems may result.

U.S. Pat. No. 5,207,186 mounts the control unit on the intake air device of the engine. As such, however, the air flow is relatively minimal and thus this patent uses radiating fins that extend into the air inlet device to assist in cooling. This provides a complicated structure and also may interfere with the efficient airflow to the engine.

It is, therefore, a principal object of this invention to provide an improved component mounting arrangement for an outboard motor.

It is a further object of this invention to provide an improved component mounting arrangement for the electrical components of an outboard motor that will assist in their cooling and ensure against intrusion of high amounts of water vapor on the electronic components.

SUMMARY OF THE INVENTION

This invention is adapted to be embodied in an outboard motor comprised of a powerhead and drive shaft housing lower unit depending from the powerhead and containing a propulsion device for propelling an associated watercraft. The powerhead includes an internal combustion engine and a surrounding protective cowling. The protective cowling is formed with an air inlet opening for admitting atmospheric air to the interior of the protective cowling. The engine is provided with an induction system that includes an air inlet device having an air inlet opening through which air from within the protective cowling is drawn for delivery to the engine combustion chamber. The air inlet device air inlet opening is spaced at the opposite end of the protective cowling from its air inlet opening. In accordance with the invention, at least one electrical component is mounted on the engine in a position contiguous to the air inlet opening of the engine air inlet device so that it will experience the air flow into the engine and cool the components.

DETAILED DESCRIPTION OF THE PREFERRED EMBODIMENTS

Figure 1:
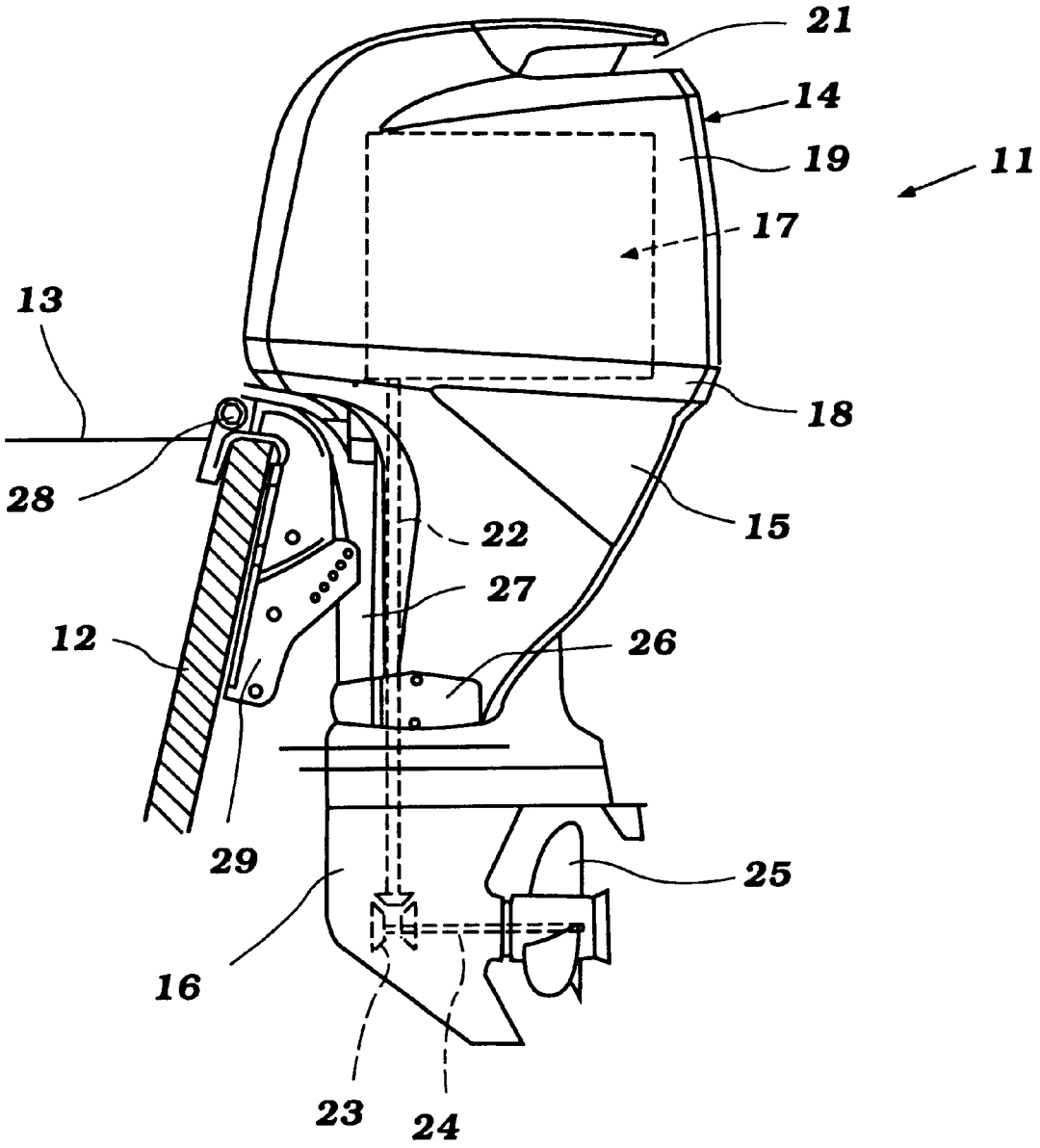
FIG. 1 is a side elevational view of an outboard motor constructed in accordance with an embodiment of the invention shown as attached to the transom of an associated watercraft that is shown partially and in cross section.

Referring now in detail to the drawings and initially to FIG. 1, an outboard motor constructed in accordance with a first embodiment of the invention is identified generally by the reference numeral 11. The outboard motor 11 is depicted as being attached to a transom 12 of a watercraft hull, shown partially and identified by the reference numeral 13.

As is typical with outboard motor practice, the outboard motor 11 is comprised of a powerhead, indicated generally by the reference numeral 14, from which a drive shaft housing 15 depends. A lower unit 16 is provided at the lower portion of the drive shaft housing 15.

The powerhead 14 is comprised of an internal combustion engine, indicated generally by the reference numeral 17 and which will be described later in more detail by reference to the remaining figures of this embodiment. This outboard motor is surrounded by a protective cowling which is comprised of a lower tray member 18 to which an upper, main cowling member 19 is detachably connected. An air inlet opening 21 is provided in the main cowling member 19 for admitting atmospheric air to the interior of the protective cowling for consumption by the engine 17 during its running.

As is typical with outboard motor practice, the engine 17 is supported within the powerhead 14 so that its crankshaft, to be identified later, rotates about a vertically extending axis. This is done so as to facilitate coupling of the engine output shaft to a drive shaft 22 that is journaled within the drive shaft housing 15 and which depends into the lower unit 16.

A bevel gear reversing transmission 23 is driven by the lower end of the drive shaft 22 and is journaled on a propeller shaft 24. By selectively coupling the driven gears of the bevel gear transmission 23 to the propeller shaft 24 in a well known manner, a propeller 25 may be driven in selected forward or reverse directions.

A steering shaft (not shown) is affixed to the drive shaft housing by means that include a lower bracket 26. This steering shaft is journaled within a swivel bracket 27 for steering the outboard motor 11 about a generally vertically extending steering axis.

The swivel bracket 27 is connected by a pivot pin 28 to a clamping bracket 29. The clamping bracket 29 is affixed in a suitable manner to the transom 12. Pivotal movement of the swivel bracket 27 relative to the clamping bracket 29 about the pivot pin 28 permits tilt and trim movement of the outboard motor 11, as is also well known in this art The construction of the outboard motor 11 as thus far described may be considered to be conventional and, therefore, where any components are not illustrated or described reference may be had to any known construction in the art for practicing the invention.

Figure 2:
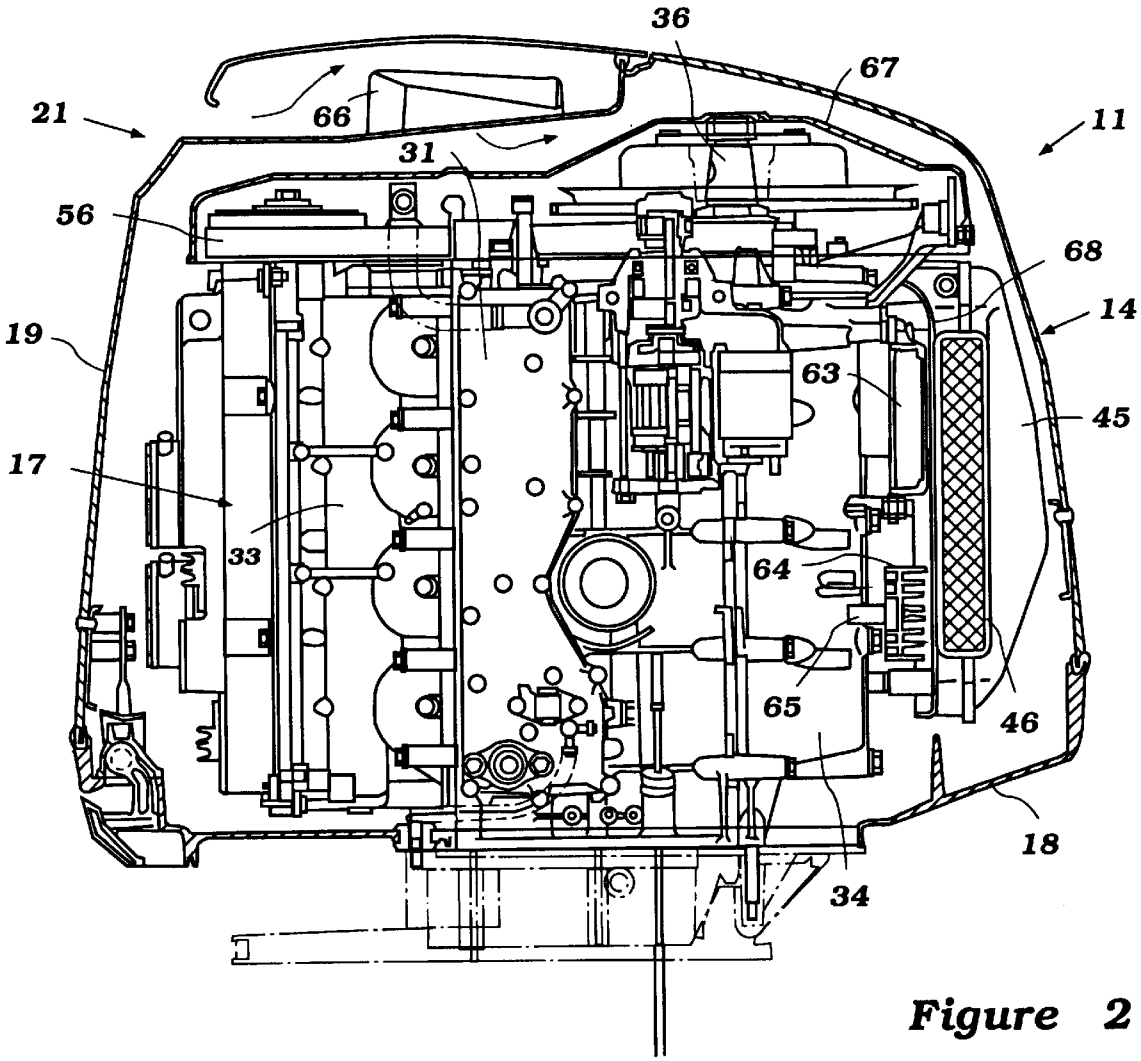
FIG. 2 is an enlarged view of the powerhead portion of the outboard motor looking in the opposite direction from FIG. 1 and with the protective cowling broken away to more clearly show the invention.
Figure 3:
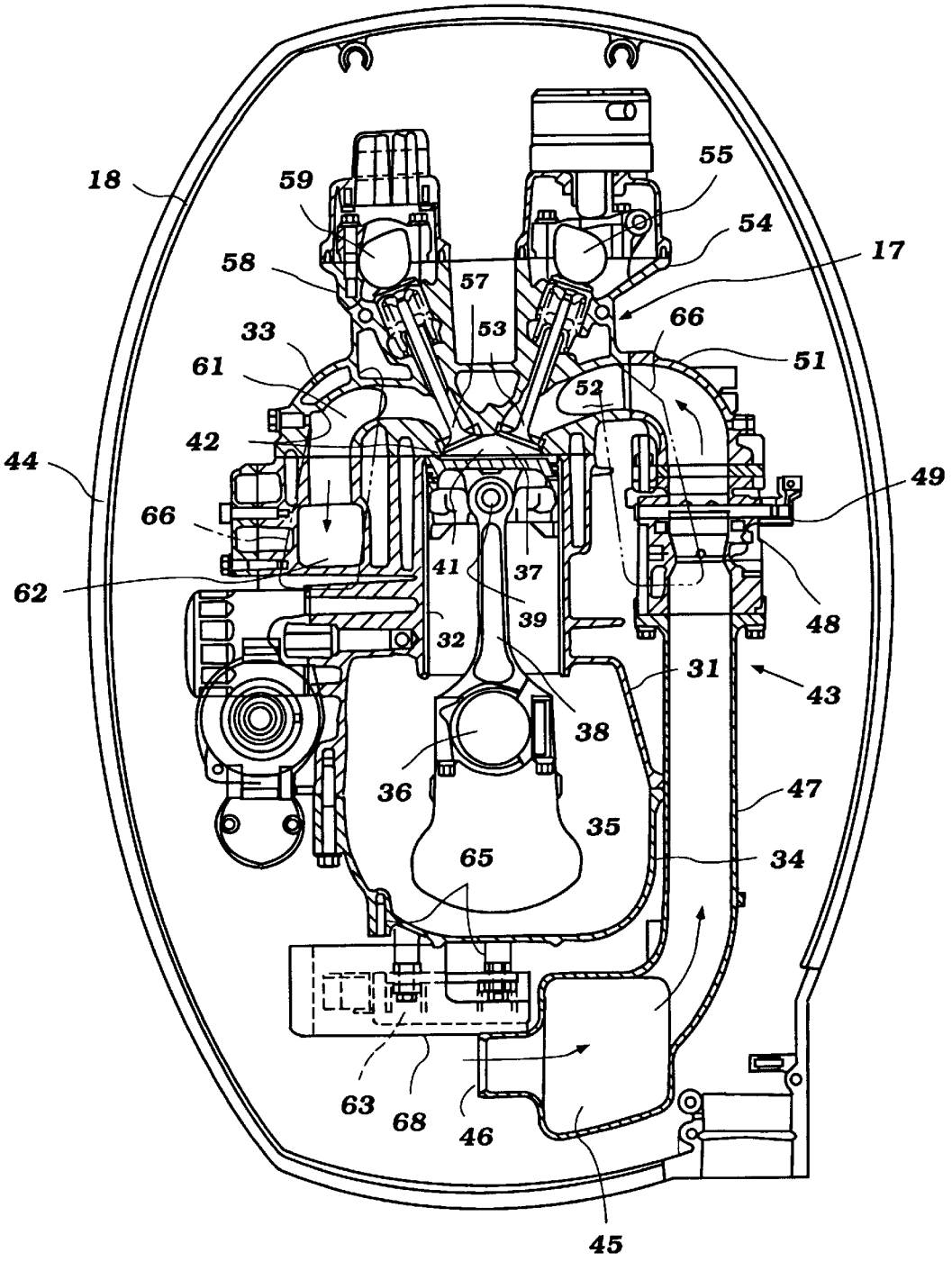
FIG. 3 is a top plan view of the powerhead with the main cowling portion removed and portions of the engine broken away and shown in section.
Figure 4:
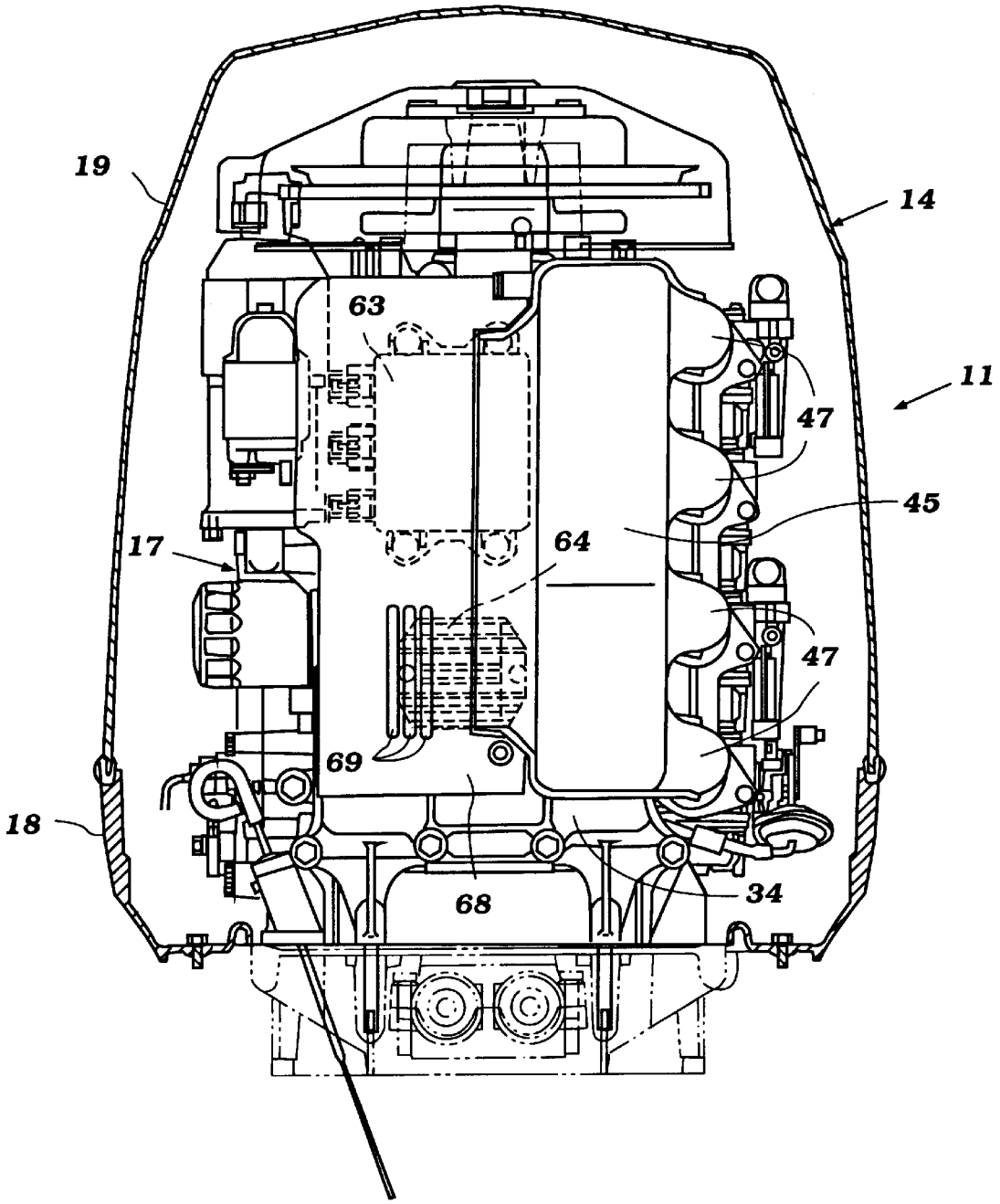
FIG. 4 is a front elevational view of the powerhead with the protective cowling broken away.
Figure 5:
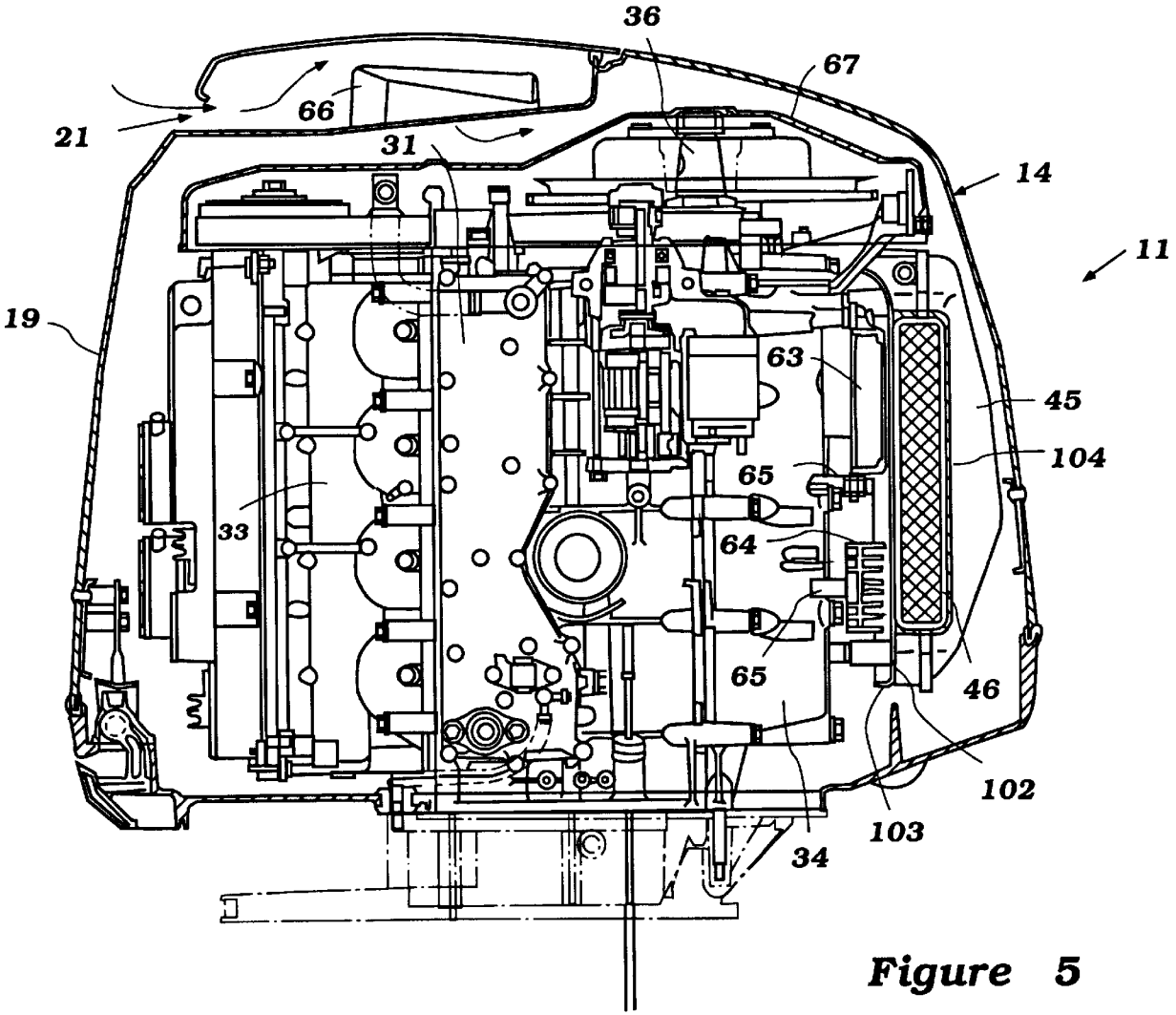
FIG. 5 is an enlarged view, in part similar to FIG. 2, and shows another embodiment of the invention.
Figure 6:
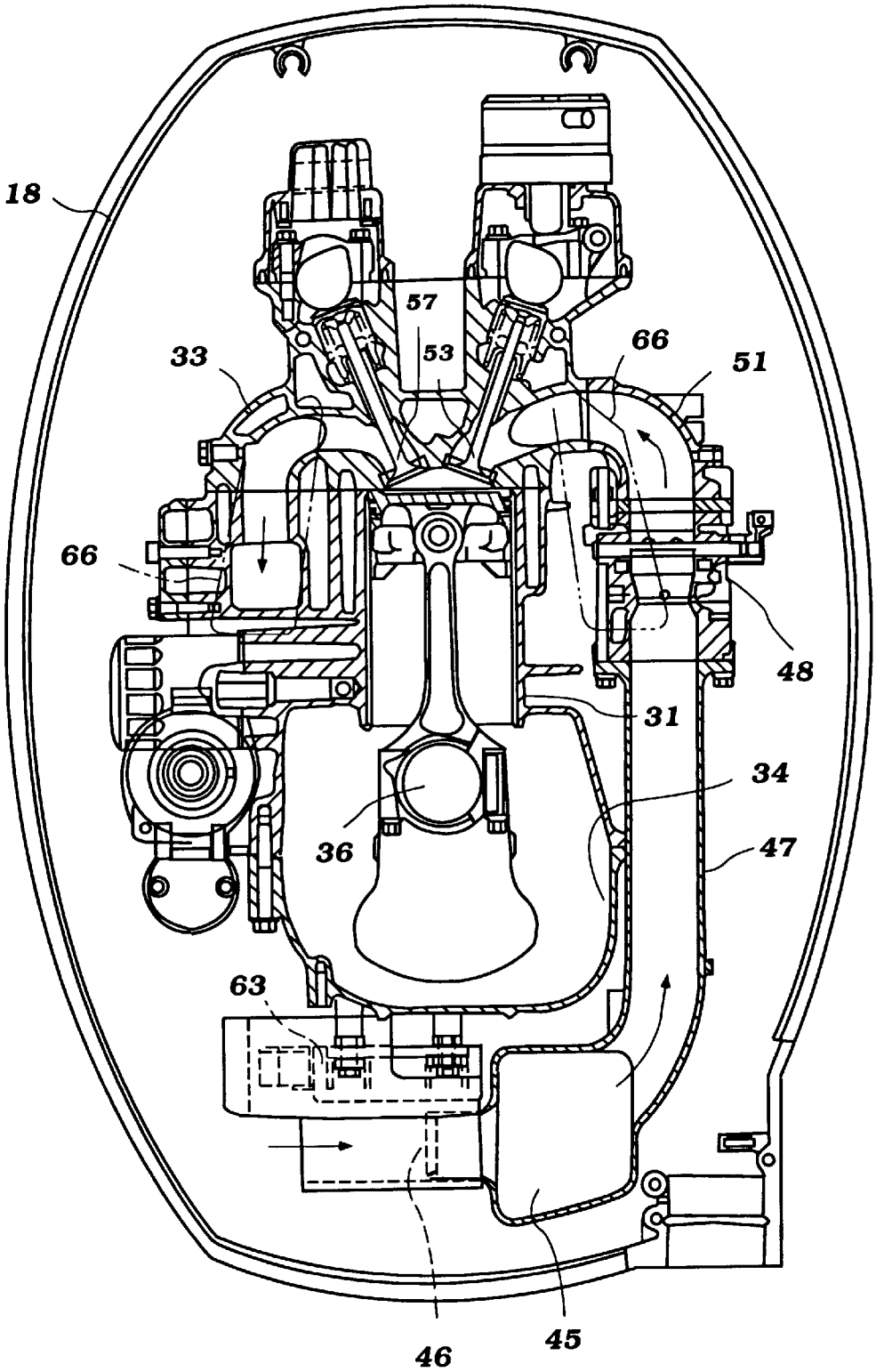
FIG. 6 is a top plan view, in part similar to FIG. 3, for this embodiment.
Figure 7:
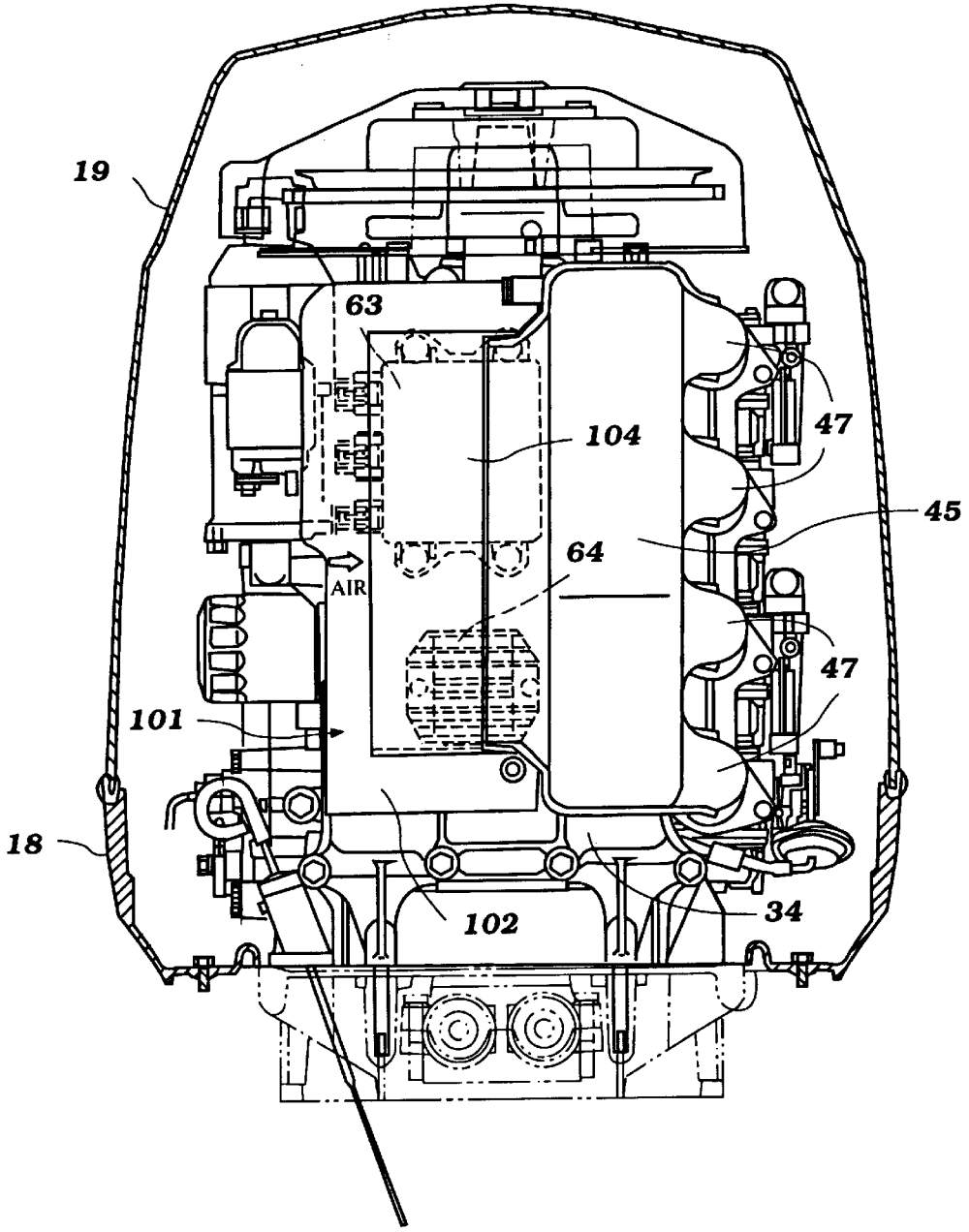
FIG. 7 is a front elevational view, in part similar to FIG. 4, again for this embodiment.
Figure 8:
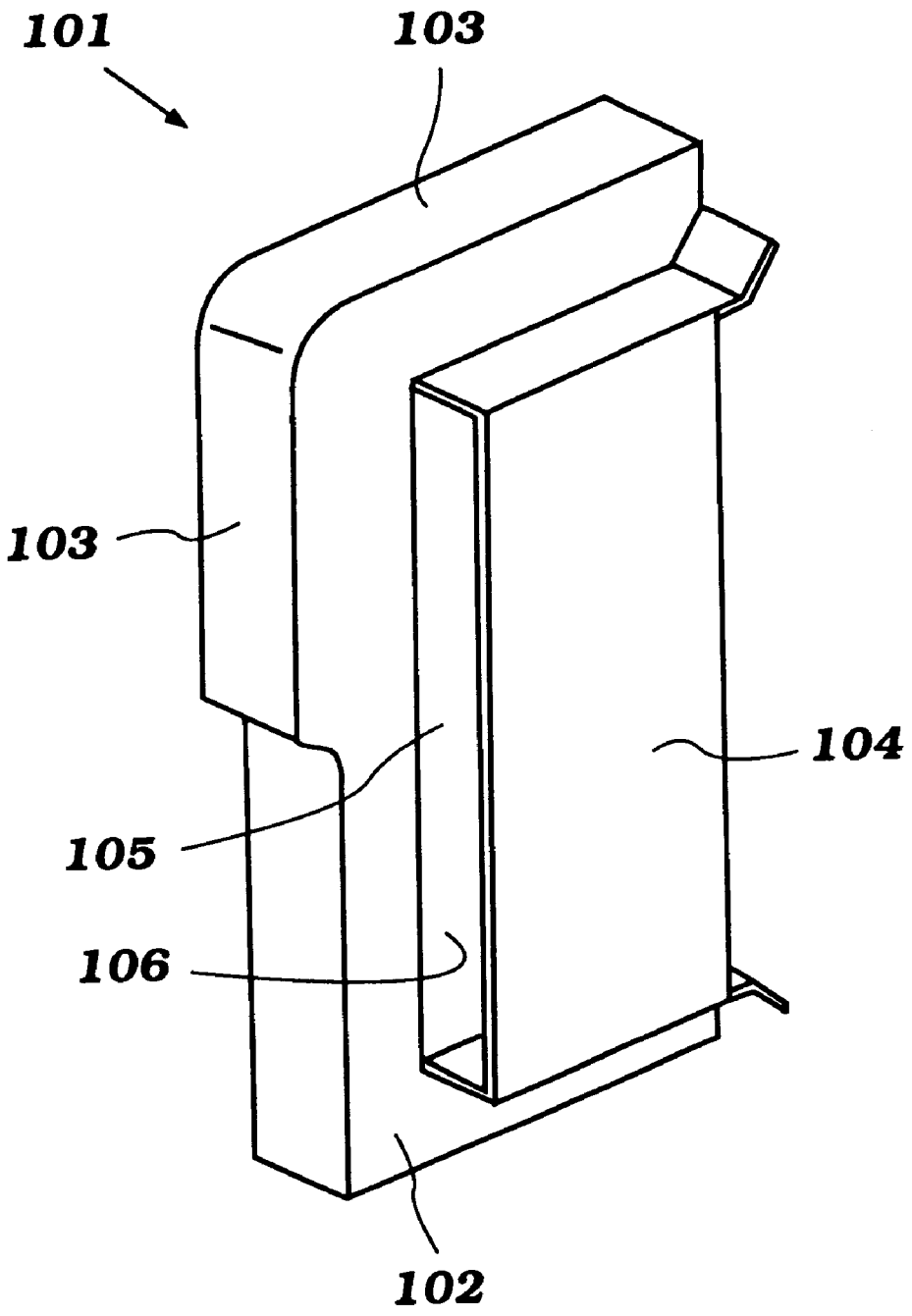
FIG. 8 is an enlarged perspective view of the air inlet device and shrouding arrangement of this embodiment.

As should be apparent from the foregoing description, the invention deals primarily with the way in which certain electrical components are mounted in the powerhead 14 rather than the overall construction of the outboard motor. Therefore, this feature of the invention will now be described by particular reference to FIGS. 2 through 4 which show the construction in the powerhead 14 of this first embodiment.

In the illustrated embodiment, the engine 17 is depicted as being of the inline type having four cylinders. It should be apparent to those skilled in the art from the following description, however, how the invention may be practiced with engines having other cylinder numbers and other cylinder configurations.

The engine 17 includes a cylinder block 31 which is formed with four cylinder bores 32 which have their cylinder bore axes extending in a generally horizontal direction, one above the other. A cylinder head assembly 33 is affixed to one end of the cylinder block 31 and closes one end of the cylinder bores 32.

In a like manner, a crankcase member 34 is affixed to the opposite end of the cylinder block 31 and defines a crankcase chamber 35 in which a crankshaft 36 is rotatably journaled. As noted previously, the engine is mounted so that the crankshaft 36 rotates about a vertically extending axis so as to facilitate its connection to the drive shaft 22.

Pistons 37 are supported for reciprocation in the cylinder bores 32. These pistons are connected to the small end of respective connecting rods 38 by piston pins 39. The big ends of the connecting rods 38 are journaled on respective throws of the crankshaft 36 in a known manner.

The cylinder head assembly 33 has individual recesses 41 which form with the heads of the pistons 37 and the cylinder bores 39, combustion chambers 42. An intake charge is delivered to these combustion chambers through an induction system, indicated generally by the reference numeral 43 and which is disposed on one side of the engine 17. An exhaust system, indicated generally by the reference numeral 44, is formed on the opposite side of the engine and collects the exhaust gases and delivers them to the atmosphere in a manner which will be described.

Referring first to the induction system 43, this includes an air inlet device comprised of a generally vertically extending plenum chamber or surge tank 45 which is disposed at a forward location in the powerhead 14 and at the side thereof spaced from the rearwardly facing air inlet opening 21 in the protective cowling member 19. The reason for this will become apparent.

It should be noted that the plenum chamber device 45 is disposed forwardly of the crankcase member 34 and substantially at one side of it. A generally elongated air inlet opening 46 is formed in a sidewardly opening portion of the plenum chamber 45 for collecting air that has been admitted to the protective cowling into the induction system 43.

A plurality of individual runners 47 extend from the plenum chamber 45 to a throttle body assembly 48 in which flow controlling throttle valves 49 are provided. These throttle valves control the speed of the engine in a well known manner.

The throttle bodies 48 in turn communicate with an intake manifold 51 that is affixed to one side of the cylinder head 33. This intake manifold 51 serves individual intake passages 52 which are formed in the cylinder head and which terminate at valve seats that are valved by intake valves 53.

The intake valves 53 are urged to close positions by coil compression spring assemblies 54. They are opened through thimble tappets by the cam lobes of an intake cam shaft 55 that is journaled in the cylinder head assembly 33 in any suitable known manner. The intake cam shaft 55 is driven at one-half crankshaft speed by a suitable timing drive, for example, the timing belt 56 which appears in FIG. 2.

Spark plugs, which are not shown, are mounted in the cylinder head 33 and fire the charge which is delivered to the combustion chambers 42. The burnt charge then exits through exhaust valve seats which are controlled by poppet-type exhaust valve 57. Like the intake valves 53, the exhaust valves 57 are urged to their closed position by coil compression spring assemblies 58. The cam lobes of an exhaust cam shaft 59 cooperate with thimble tappets so as to open the exhaust valve 57. The exhaust cam shaft 59 is also driven at one-half crankshaft speed by the timing belt 56.

The exhaust valves 57, when open, permit the flow of the combustion products into exhaust passages 61 formed in the cylinder head 33 on the side opposite the intake passage 52. These exhaust passages 61 communicate with an exhaust manifold 62 that is formed in the cylinder block 31 and which communicates with a conventional type of exhaust system for discharging the exhaust gases from the engine to the atmosphere through a suitable marine-type exhaust system. This may include a through the hub underwater exhaust gas discharge for high-speed running and an above the water exhaust gas discharge when operating at low speeds or idle. Again, these components form no portion of the invention It should be readily apparent from the foregoing description that the described construction provides a very compact assembly. Thus, there is very little room within the protective cowling of the powerhead 14 around the engine 17.

This presents certain problems in connection with the mounting of electrical control units such as the ECU or ignition circuit 63 which fires the spark plugs and a rectifier regulator unit 64 for rectifying the output of a magneto generator associated with the engine. In accordance with the invention, these units 63 and 64 are mounted on mounting bosses 65 formed on the crankcase member 34 at a spaced location from the hotter cylinder head end of the engine.

In addition, these components are mounted in close proximity to the air inlet opening 46 of the induction system 43. Hence, the flow of air caused by the induction system will cause cooling air to flow in proximity to if not across these electrical components 63 and 64. This cooling air flow will now be described by primary reference to FIGS. 2 and 3.

It will be seen that the air inlet device 21 is positioned at the rear and upper portion of the main cowling member 19. This air inlet device includes a baffling arrangement 66 so as to assist in water separation. The air inducted into the interior of the protective cowling will then flow across a belt shield 67 mounted on the upper end of the engine and downwardly toward the air inlet device 46 of the induction system. This relatively long path will assist in water removal from the inducted air. Hence, the air will flow down along the electrical components and cool them.

In order to protect them from water damage, however, a sheet metal shroud 68 may *be fixed over them so as to provide protection without significantly retarding air flow. In fact, some air flow will occur through the shroud and into the inlet opening 46. Hence, these sensitive electrical components which comprise the ECU 63 and rectifier regulator 64 will be cooled. The shroud 68 may also be formed with a plurality of air flow slots 69 adjacent the rectifier regulator 64 so as to facilitate the dissipation of heat.

FIGS. 5–8 show another embodiment of the invention. This embodiment is substantially the same as the embodiment of FIGS. 1–4. It differs from that embodiment only in the configuration of the protective shroud for the induction system and for the electrical components 63 and 64.

This shroud is indicated generally by the reference numeral 101 in this embodiment and since this is the only difference from the previously described embodiment, those components which have already been described and which are the same are identified by the same reference numerals. The shroud 101 may be formed from sheet metal or some lightweight material and has a generally box shape comprised of a first portion 102 that has a peripheral edge 103 that generally surrounds the area containing the electrical components 63 and 64, these being the ECU 63 and rectifier regulator 64.

A second box-shaped portion 104 lies over the portion 102 and has a somewhat smaller configuration. This portion defines opening 105 through which air may flow through the inlet device opening 64 clearly shown in FIG. 5. However, the area beneath the box-shaped portion 104 also provides a large opening 106 which overlies the components 63 and 64 and hence permits free air flow toward them. In this way, the components 63 and 64 are protected from water vapor but will not be blocked from the significant air flow that is passing into the induction system. Thus, this embodiment also provides good protection for the components 63 and 64 as well as adequate cooling for them.

Thus, it should be readily apparent from the foregoing description that the described embodiment of the invention provide a very compact assembly for the powerhead of an outboard motor and yet on in which the electrical components can be protectively mounted and well cooled. Of course, the foregoing description is that of a preferred embodiment of the invention. Various changes and modifications may be made without departing from the spirit and scope of the invention, as defined by the appended claims.

What is claimed is:

1. An outboard motor comprised of a powerhead and drive shaft housing lower unit depending from said powerhead and containing a propulsion device for propelling an associated watercraft, said powerhead including an internal combustion engine and a surrounding protective cowling, said protective cowling being formed with an air inlet opening for admitting atmospheric air to the interior of the protective cowling, said engine being provided with an induction system that includes an air inlet device having an air inlet opening through which air from within the protective cowling is drawn for delivery to the engine combustion chamber, said air inlet device air inlet opening being spaced at the opposite end of said protective cowling from its air inlet opening, and at least one electrical component for controlling a separate source of electrical power is mounted on said engine in a position contiguous to said air inlet opening of said engine air inlet device so that it will experience the air flow into the engine and cool said electrical component.

2. The outboard motor as set forth in claim 1 wherein the electrical component is an ignition control system for the engine.

3. The outboard motor as set forth in claim 1 wherein the electrical component is a rectifier for a generating system of the engine.

4. The outboard motor as set forth in claim 3 wherein the electrical component further includes an ignition control system for the engine.

5. The outboard motor as set forth in claim 1 wherein a shroud at least partially encloses the electrical component without interfering with the air flow across the electrical component.

6. The outboard motor as set forth in claim 5 wherein the shroud also encloses the air inlet opening of the engine air inlet device.

7. The outboard motor as set forth in claim 6 wherein the shroud has an opening that communicates encloses the air inlet opening of the engine air inlet device with the electrical component.

8. The outboard motor as set forth in claim 1 wherein the engine is a four cycle engine having a cylinder block with at least one horizontally extending cylinder bore, a cylinder head closing one end of said cylinder bore and underlying the protective cowling air inlet opening, a crankcase member fixed to said cylinder block and closing the other end of said cylinder bore and spaced from said protective cowling air inlet opening, the electrical component being supported on said crankcase member.

9. An outboard motor comprised of a powerhead and drive shaft housing lower unit depending from said powerhead and containing a propulsion device for propelling an associated watercraft, said powerhead including an internal combustion engine and a surrounding protective cowling, said protective cowling being formed with an air inlet opening for admitting atmospheric air to the interior of the protective cowling, said engine comprising a four cycle engine having a cylinder block with at least one horizontally extending cylinder bore, a cylinder head closing one end of said cylinder bore and underlying said protective cowling air inlet opening, a crankcase member fixed to said cylinder block and closing the other end of said cylinder bore and spaced from said protective cowling air inlet opening, and an induction system including an air inlet device having an air inlet opening spaced at the opposite end of said protective cowling from its air inlet opening and through which air from within said protective cowling is drawn for delivery to an engine combustion chamber, said engine air inlet device being supported adjacent said crankcase member and including a vertically extending plenum chamber, said air inlet opening of said engine air inlet device entering said plenum chamber through a side thereof and extending across the peripheral surface of said crankcase member, and at least one electrical component mounted on said engine in a position contiguous to said air inlet opening of said engine air inlet device so that it will experience the air flow into said engine and cool said electrical component.

10. The outboard motor as set forth in claim 9 wherein the electrical component is an ignition control system for the engine.

11. The outboard motor as set forth in claim 9 wherein the electrical component is a rectifier for a generating system of the engine.

12. The outboard motor as set forth in claim 11 wherein the electrical component further includes an ignition control system for the engine.

13. The outboard motor as set forth in claim 12 wherein a shroud at least partially encloses the electrical components without interfering with the air flow across the electrical component.

14. The outboard motor as set forth in claim 13 wherein the shroud also encloses the air inlet opening of the engine air inlet device.

15. The outboard motor as set forth in claim 14 wherein the shroud has an opening that communicates encloses the air inlet opening of the engine air inlet device with the electrical component.

* * * * *